US008762028B2

(12) United States Patent
Kim et al.

(10) Patent No.: US 8,762,028 B2
(45) Date of Patent: Jun. 24, 2014

(54) METHOD OF PREVENTING DAMAGE TO GPF IN VEHICLE ADOPTED TO CDA

(75) Inventors: Taewook Kim, Gunpo-si (KR); Jinha Lee, Seoul (KR)

(73) Assignee: Hyundai Motor Company, Seoul (KR)

( * ) Notice: Subject to any disclaimer, the term of this patent is extended or adjusted under 35 U.S.C. 154(b) by 278 days.

(21) Appl. No.: 13/308,341

(22) Filed: Nov. 30, 2011

(65) Prior Publication Data

US 2013/0060446 A1 Mar. 7, 2013

(30) Foreign Application Priority Data

Sep. 2, 2011 (KR) ..... 10-2011-0088982

(51) Int. Cl.
*F02D 43/04* (2006.01)
*F02D 43/00* (2006.01)

(52) U.S. Cl.
USPC ..... 701/102; 123/481

(58) Field of Classification Search
CPC ..... F01N 3/023; F01N 9/002; F02D 41/0087; F02D 41/029
USPC ..... 701/102, 112; 123/481, 325, 332, 198 F; 60/274, 295, 297, 299
See application file for complete search history.

(56) References Cited

U.S. PATENT DOCUMENTS

| | | | | |
|---|---|---|---|---|
| 8,181,452 | B2 * | 5/2012 | Bidner et al. | 60/295 |
| 8,327,628 | B2 * | 12/2012 | Ruona et al. | 60/295 |
| 2009/0193796 | A1 | 8/2009 | Wei et al. | |
| 2011/0120090 | A1 | 5/2011 | Sorensen, Jr. | |

FOREIGN PATENT DOCUMENTS

| | | | |
|---|---|---|---|
| JP | 2006-83834 | A | 3/2006 |
| JP | 2010-174742 | A | 8/2010 |
| KR | 10-2009-0063944 | A | 6/2009 |
| KR | 10-2009-0126619 | A | 12/2009 |

* cited by examiner

*Primary Examiner* — Mahmoud Gimie
(74) *Attorney, Agent, or Firm* — Morgan, Lewis & Bockius LLP

(57) ABSTRACT

A method of preventing damage to a Gasoline Particulate Filter (GPF) of a vehicle adapted to Cylinder De-activation (CDA) may include monitoring GPF pressure difference that measures a pressure difference of the GPF and determines an accumulation amount of soot in the GPF in accordance with the measured pressure difference of GPF; comparing pressure difference that compares the measured pressure difference of the GPF with a predetermined reproduction pressure difference; calculating GPF temperature that calculates a temperature in the GPF in accordance with each one of CDA modes, based on the accumulation amount of soot and an average oxygen concentration of an exhaust gas for the each one of the CDA modes; and setting CDA mode that determines a number of cylinders available for an CDA operation based on the calculated temperature and a predetermined temperature established for preventing the GPF from a damage.

4 Claims, 5 Drawing Sheets

FIG.5

| MODE | cyl 1 | cyl 2 | cyl 3 | cyl 4 | AVERAGE |
|---|---|---|---|---|---|
| CDA 0 | 1% | 1% | 1% | 1% | 1% |
| CDA 1 | 1% | 1% | 1% | 21% | 6% |
| CDA 2 | 1% | 1% | 21% | 21% | 11% |
| CDA 3 | 1% | 21% | 21% | 21% | 16% |

METHOD OF PREVENTING DAMAGE TO GPF IN VEHICLE ADOPTED TO CDA

CROSS-REFERENCE TO RELATED APPLICATIONS

The present application claims priority of Korean Patent Application Number 10-2011-0088982 filed Sep. 2, 2011, the entire contents of which application are incorporated herein for all purposes by this reference.

BACKGROUND OF INVENTION

1. Field of Invention

The present invention relates to a method for preventing damage to a Gasoline Particulate Filter (GPF) of a gasoline engine, particularly a method of preventing damage to a GPF in a vehicle adopted to Cylinder De-activation (CDA) which determines the number of cylinders of a gasoline engine adopted to CDA to prevent the GPF from being damaged by using the internal temperature conditions of the GPF.

2. Description of Related Art

Recently, with the increasing demand on output and efficiency in engines, a Gasoline Direct Injection (GDI) type engine that directly injects the fuel into the cylinder is used even for the gasoline engines.

The generation of particulate materials (PM) due to the increase in incomplete combustion section in the combustion chamber becomes a problem in Turbocharged Gasoline Direct Injection (T-GDI) engines, which is implemented by mounting a turbocharger on the GDI engine, in addition to the GDI engine.

Researches for mounting the Gasoline Particulate Filter (GPF) that functions as a soot filter that is used in the diesel engines to remove the problem of the generation of PMs have been conducted. However, since the gasoline vehicles operate with a stoichiometric ratio, it is difficult to reuse the soot filter due to insufficient oxygen in the exhaust gas when the PMs accumulated in the filter is reproduced, such that it takes a large amount of time to reproduce the soot filter.

Meanwhile, in Cylinder De-activation (CDA) engine adopted to a technology of providing a non-operation period by stopping supply of fuel to some of a plurality of cylinders in order to improve fuel efficiency in deceleration or low-speed traveling, the air discharged through the cylinders where the fuel is not supplied is discharged to the outside through the exhaust manifold. The air discharged through the cylinder where the fuel is not supplied contains oxygen at the same ratio as the atmosphere because it does not undergo combustion.

There is a problem in that the oxygen in the air causes damage to the GPF by accelerating oxidization of the PMs while the air containing a large amount of oxygen is discharged to the outside through the exhaust line.

Meanwhile, a technology for removing the PMs in the GDI engine and a technology about the CDA engine has been disclosed in KR 10-2009-0063944 A and KR 10-2009-0126619 A as the related art.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention are directed to provide a method of preventing damage to Gasoline Particulate Filter (GPF) in a vehicle provided with a gasoline engine adapted to Cylinder De-activation (CDA).

Exemplary methods according to various aspects of the present invention may include a step of monitoring GPF pressure difference that measures a pressure difference of the GPF and determines an accumulation amount of soot in the GPF in accordance with the measured pressure difference of GPF; a step of comparing pressure difference that compares the measured pressure difference of the GPF with a predetermined reproduction pressure difference; a step of calculating GPF temperature that calculates a temperature in the GPF in accordance with each one of CDA modes, based on the accumulation amount of soot and an average oxygen concentration of an exhaust gas for the each one of the CDA modes; and a step of setting CDA mode that determines a number of cylinders available for an CDA operation based on the calculated temperature and a predetermined temperature established for preventing the GPF from a damage.

The step of setting CDA mode may set the CDA modes such that a temperature of the GPF is equal to or below the predetermined temperature. The predetermined temperature may be approximately 1250° C.

The method may further include a step of starting GPF reproduction that starts a reproduction of the GPF after the step of setting CDA mode; a step of determining overrun entry that determines whether the vehicle has entered an overrun condition while the GPF is reproduced; a step of determining completion of GPF reproduction that compares the pressure difference in the GPF with the reproduction finish pressure difference if the vehicle has not entered the overrun condition; and a step of finishing GPF reproduction that finishes the reproduction of the GPF when the pressure difference in the GPF is lower than the reproduction finish pressure difference in the step of determining completion of GPF reproduction.

Still yet, the method may further include a step of stopping CDA operation that terminates the reproduction of the GPF, terminates the CDA operation and returns to the step of comparing pressure difference if the vehicle has entered the overrun condition.

According to the method of preventing damage to a GPF of a vehicle adapted to CDA having the configuration of the present invention, it is possible to preclude the GPA from being exposed to high temperature and damaged when it is reproduced in a vehicle adapted to CDA by determining the number of cylinders to be stopped based on the pressure difference and temperature of the GPF.

Further, it is possible to maximize fuel efficiency because reproduction is always possible by preventing damage to the GPF, such that it is possible to keep the performance of the vehicle.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIG. 5 is a view showing the average oxygen concentration according to the CDA operation used in exemplary methods of the present invention.

Figure 1:
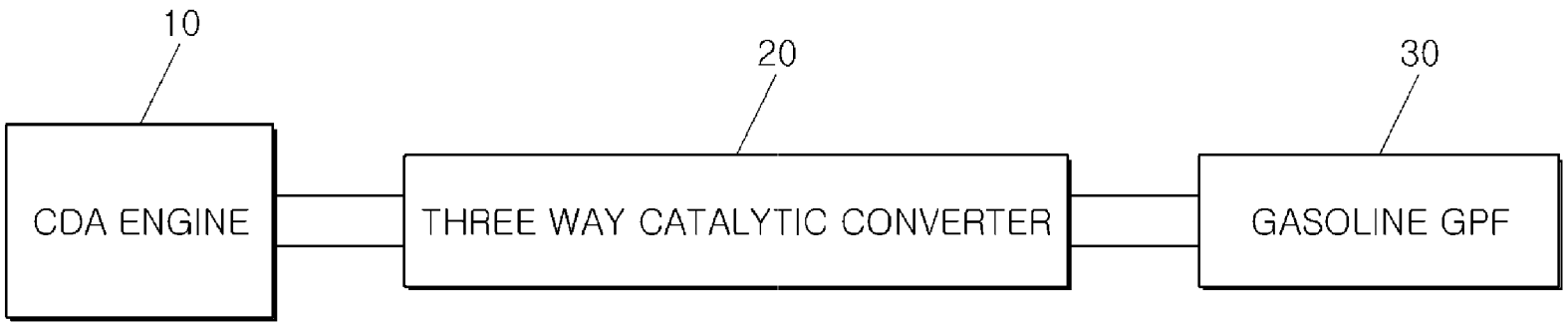
FIG. 1 is a schematic view of a system on which an exemplary method of the present invention for preventing damage to Gasoline Particulate Filter (GPF) is applied.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A method of preventing damage to Gasoline Particulate Filter (GPF) in a vehicle adapted to Cylinder De-activation (CDA) according to various embodiments of the present invention is described hereafter in detail with reference to the accompanying drawings.

Referring to FIG. 1, a method of preventing damage to GPF in a vehicle adapted to CDA according to the various embodiments of the present invention is applied to an engine system equipped with a three way catalytic converter 20 and a GPF 30 that are disposed in an exhaust line behind a Gasoline Direct Injection (GDI) or Turbocharged Gasoline Direct Injection (T-GDI) type CDA engine 10.

Figure 2:
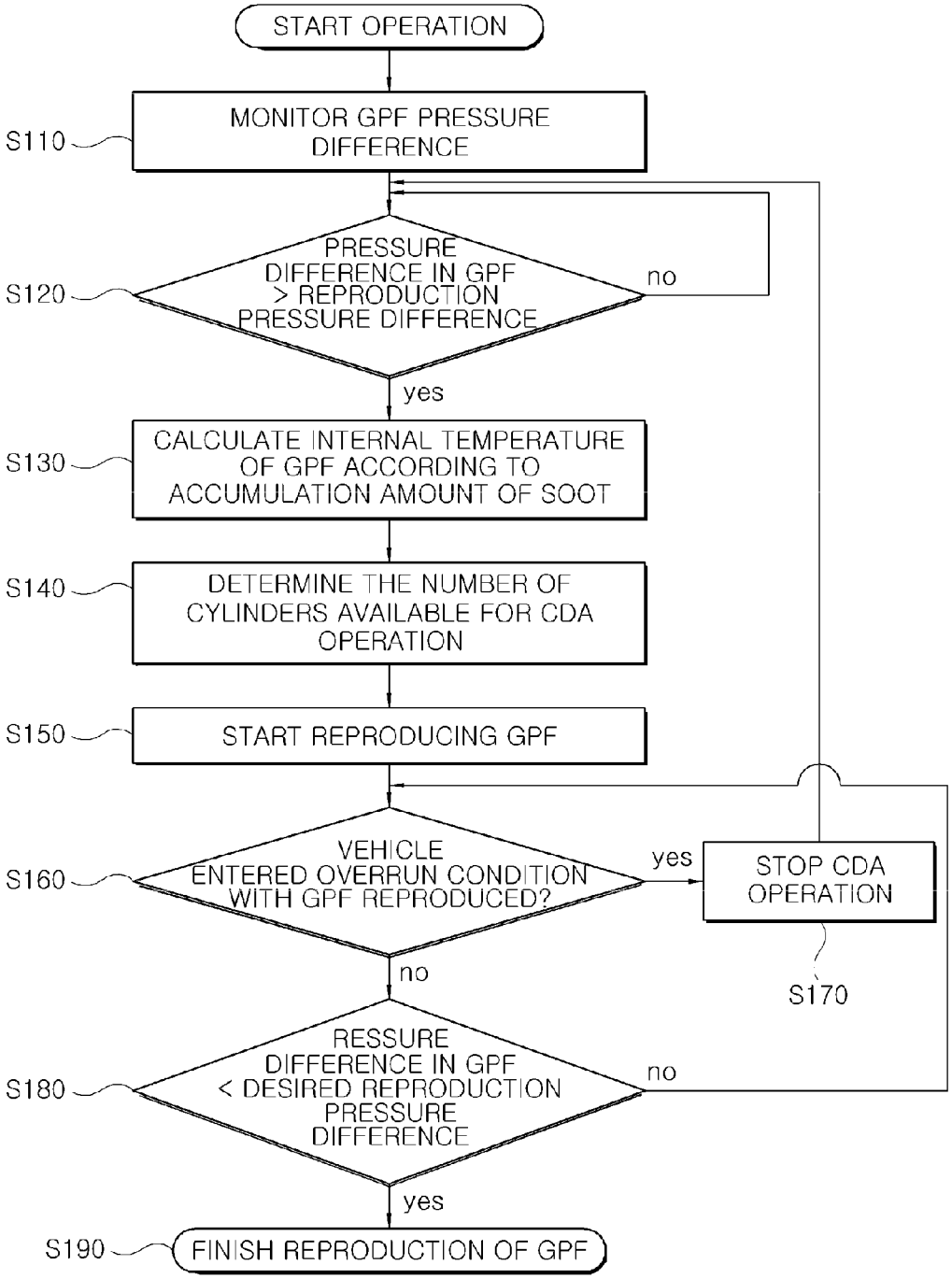
FIG. 2 is a flowchart illustrating an exemplary method of preventing damage to GPF in a vehicle adapted to CDA according to various aspects of the present invention.
Figure 3:
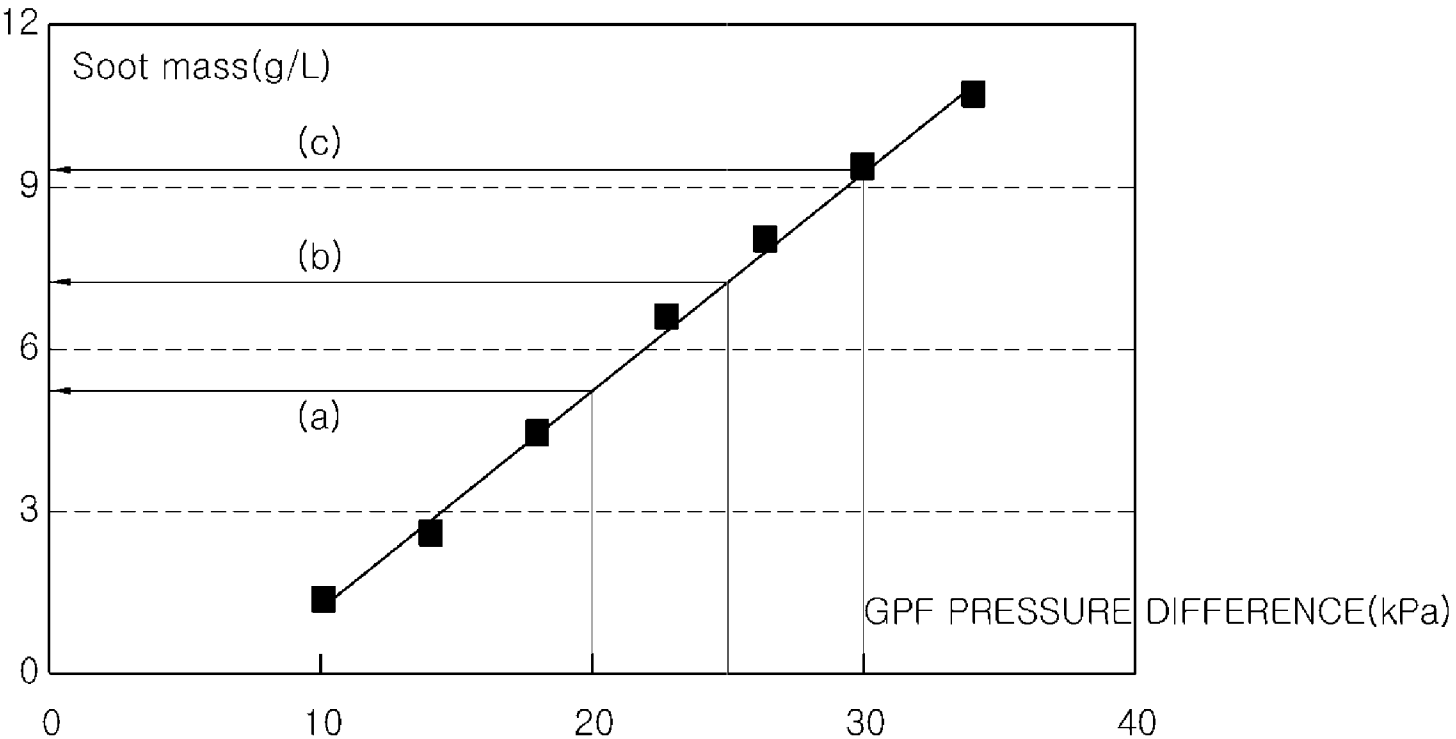
FIG. 3 is a graph showing the accumulation amount of soot relative to GPF pressure difference used in exemplary methods of the present invention.

As shown in FIG. 2, a step of monitoring GPF pressure difference S110 periodically measures the pressures at the front end and the rear end of GPF 30 and continuously calculates the pressure difference in the GPF by comparing the pressures. The accumulation amount of soot in GPF 30 and the pressure difference in GPF are proportionate as shown in FIG. 3. The pressure difference in GPF is monitored as a method of indirectly measuring the accumulation amount of soot in GPF 30.

A step of comparing pressure difference S120 compares the pressure difference in GPF 30 that is measured in the step of monitoring GPF pressure difference S110 with a predetermined reproduction pressure difference. That is, when the GPF pressure difference is equal to or more than a predetermined value and excessive soot is accumulated in GPF 30, efficiency of GPF 30 and exhaust efficiency are reduced, such that it is required to reproduce GPF 30, which requires the following processes. When the pressure difference of GPF 30 is equal to or less than the predetermined value, the amount of soot accumulated in GPF 30 is small and it is not required to reproduce GPF 30. The pressure difference of GPF 30 and the predetermined reproduction pressure difference are repeatedly compared.

A step of calculating GPF temperature S130 calculates the internal temperature of GPF 30 in each CDA mode. It is done by first putting the pressure difference of GPF 30 acquired by step of monitoring GPF pressure difference S110 into FIG. 3 to get the corresponding accumulation amount of soot, and then using the graph of FIG. 4 to deduce the internal temperature of GPF 30 according to each CDA mode based on the accumulation amount of soot and the oxygen concentration.

Based on the deduced internal temperature of GPF 30, a step of setting CDA mode S140 determines the number of cylinders to be stopped while maintaining the GPF 30 to operate at or less than a temperature, above which GPF 30 would be damaged. Such a temperature is typically around 1250° C. In various embodiments, this temperature is set at 1250° C. One will appreciate that the value of this temperature may vary depending on the materials and structures of the GPF.

Figure 4:
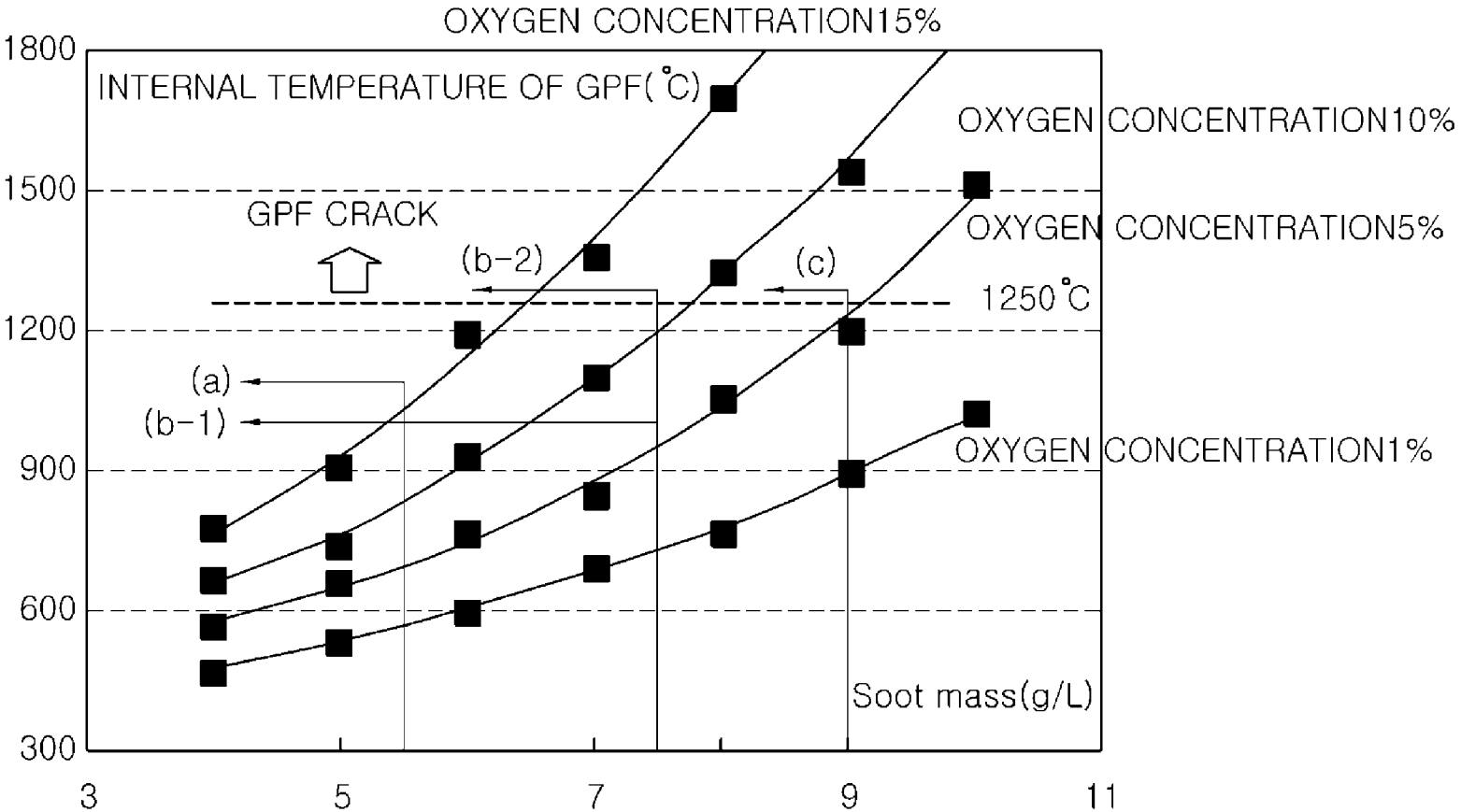
FIG. 4 is a graph showing the internal temperature of GPF relative to the accumulation amount of soot and the average oxygen concentration for each CDA mode used in exemplary methods of the present invention.

Step of calculating GPF temperature S130 and step of setting CDA mode S140 are described in detail by using an example illustrated in FIGS. 3 to 5.

FIGS. 3 and 4 shows empirical data acquired from accumulated experimental values and FIG. 5 shows the average oxygen concentration according to the CDA mode in a four-cylinder engine. That is, in FIG. 5, since most oxygen is used for combustion in the cylinders that are in operation, the concentration is about 1% and the oxygen concentration in the cylinders that are stopped is about 21%, which is the same as that of oxygen in the atmosphere, and the arithmetic average of them is the average oxygen concentration according to each CDA mode.

In FIG. 3, it is exemplified that the pressure difference of GPF 30 is 20 kPa (a), 25 kPa (b), and 30 kPa (c). When the pressure difference of GPF 30 is 20 kPa, CDA operation can be implemented such that fuel is not supplied to three cylinders in a four-cylinder engine, but when the pressure difference of GPF 30 is 30 kPa, none of the cylinders can be stopped, and when the pressure difference of GPF 30 is 25 kPa, only one cylinder can be stopped.

First, when the pressure difference of GPF 30 indicated by (a) in FIG. 3 is 20 kPa, the accumulation amount of soot is about 5.5 g/L. In FIG. 4, when the accumulation amount of soot is 5.5 g/L, the temperature of GPF 30 according to the oxygen concentration is described. Since the temperature of GPF 30 is about 1100° C. even though the average oxygen concentration is 16% where the CDA is operated at the maximum level, even CDA-3 mode for stopping three cylinders in accordance with the required output in the vehicle can be implemented. That is, it is possible to stop maximally three cylinders when a large amount of output is not required, such as decelerating, low-speed traveling, or traveling on a downhill, in a vehicle equipped with a four-cylinder engine.

When the pressure difference of GPF 30 indicated by (b) is 25 kPa in FIG. 3, the accumulation amount of soot is about 7.5 g/L, and it is possible to stop one cylinder by FIGS. 4 and 5, but it is impossible to stop two or more cylinders. That is, as indicated by (b-1) in FIG. 4, when the oxygen concentration is 6%, the internal temperature of GPF 30 is about 1000° C., such that it is possible to stop one cylinder, but as indicated by (b-2), when the oxygen concentration is 11%, the temperature of GPF 30 exceeds about 1250° C., such that it is impossible to stop two or more cylinders.

Meanwhile, when the pressure difference of GPF 30 indicated by (c) in FIG. 3 is 30 kPa, the accumulation amount of soot is about 9 g/L, in which, as indicated by (c) in FIG. 4, the temperature exceeds 1250° C., the critical temperature of GPF 30 even if only one cylinder is stopped, such that the CDA mode cannot be applied.

Referring back to FIG. 2, after the CDA mode is set, a step of starting GPF reproduction S150 that reproduces the GPF is performed. When the soot continues to be accumulated in GPF 30, the performance of GPF 30 is reduced, such that reproduction is performed by heating the soot to be oxidized, by using post-injection to increase the temperature of GPF 30 to a predetermined temperature or above when the soot accumulated is equal to or more than a predetermined amount.

A step of determining overrun entry (S160) determines whether it has entered an overrun condition, when the engine is in operation while GPF 30 is reproduced. That is, as the output of engine 10 is limited by stopping of some cylinders in the CDA mode, it is necessary to induce sufficient output from engine 10 by supplying fuel into all cylinders in accelerating, traveling at a middle speed or more, or an uphill, not when the vehicle is decelerated, travels at a low speed, or travels on a downhill. Therefore, it is necessary to determine whether the CDA is stopped, by periodically determining whether the vehicle enters the overrun.

When it is determined that the vehicle has entered the overrun in the step of determining overrun entry S160, it is necessary to stop the CDA operation (S170) and supply fuel into all of the cylinders such that engine 10 makes sufficient output.

When it is determined that the vehicle has not entered the overrun in the step of determining overrun entry S160, a step of determining completion of GPF reproduction (S180) that determines whether to finish the reproduction of GPF 30 is performed.

Step of determining completion of GPF reproduction (S180) compares the pressure difference in the GPF with a desired reproduction finish pressure difference and finishes the reproduction of GPF 30 when it is determined that the pressure difference in the GPF is lower than the desired reproduction finish pressure difference, which means GPF 30 has been sufficiently reproduced.

When the pressure difference in the GPF is higher than the desired reproduction finish pressure difference in step of determining completion of GPF reproduction (S180), reproduction of GPF 30 continues until the resultant pressure difference in the GPF is less than the desired reproduction finish pressure difference. During the reproduction of GPF 30, the step of determining overrun entry (S160) and succeeding steps are periodically and repeatedly performed.

For convenience in explanation and accurate definition in the appended claims, the terms front or rear, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method of preventing damage to a Gasoline Particulate Filter (GPF) of a vehicle adapted to Cylinder De-activation (CDA), the method comprising:

a step of monitoring GPF pressure difference that measures a pressure difference of the GPF and determines an accumulation amount of soot in the GPF in accordance with the measured pressure difference of GPF;

a step of comparing pressure difference that compares the measured pressure difference of the GPF with a predetermined reproduction pressure difference;

a step of calculating GPF temperature that calculates a temperature in the GPF in accordance with each one of CDA modes, based on the accumulation amount of soot and an average oxygen concentration of an exhaust gas for the each one of the CDA modes; and a step of setting CDA mode that determines a number of cylinders available for an CDA operation based on the calculated temperature and a predetermined temperature established for preventing the GPF from a damage, a step of starting GPF reproduction that starts a reproduction of the GPF after the step of setting CDA mode;

a step of determining overrun entry that determines whether the vehicle has entered an overrun condition while the GPF is reproduced;

a step of determining completion of GPF reproduction that compares the pressure difference in the GPF with the reproduction finish pressure difference if the vehicle has not entered the overrun condition; and a step of finishing GPF reproduction that finishes the reproduction of the GPF when the pressure difference in the GPF is lower than the reproduction finish pressure difference in the step of determining completion of GPF reproduction.

2. The method as defined in claim 1, wherein the step of setting CDA mode sets the CDA modes such that the temperature of the GPF is equal to or below the predetermined temperature.

3. The method as defined in claim 1, further comprising:

a step of stopping CDA operation that terminates the reproduction of the GPF, terminates the CDA operation and returns to the step of comparing pressure difference if the vehicle has entered the overrun condition.

4. The method as defined in claim 2, wherein the predetermined temperature is approximately 1250° C.

* * * * *